US007815394B2

(12) United States Patent
Bergmann

(10) Patent No.: US 7,815,394 B2
(45) Date of Patent: Oct. 19, 2010

(54) DEVICE FOR A WATERCRAFT FOR PICKING UP AND LAUNCHING BOATS

(75) Inventor: Hans Dieter Bergmann, Bassum (DE)

(73) Assignee: Global Davit GmbH, Bassum (DE)

( * ) Notice: Subject to any disclaimer, the term of this patent is extended or adjusted under 35 U.S.C. 154(b) by 0 days.

(21) Appl. No.: 12/310,466

(22) PCT Filed: Aug. 29, 2007

(86) PCT No.: PCT/DE2007/001545

§ 371 (c)(1),
(2), (4) Date: Feb. 25, 2009

(87) PCT Pub. No.: WO2008/025345

PCT Pub. Date: Mar. 6, 2008

(65) Prior Publication Data

US 2009/0257826 A1 Oct. 15, 2009

(30) Foreign Application Priority Data

Aug. 30, 2006 (DE) ..... 10 2006 040 617

(51) Int. Cl.
*B63B 23/32* (2006.01)

(52) U.S. Cl. ..... 405/3; 405/1; 114/368; 114/365

(58) Field of Classification Search ..... 405/1, 405/2, 3; 114/372, 373, 374, 375, 365, 368
See application file for complete search history.

(56) References Cited

U.S. PATENT DOCUMENTS

RE27,090 E * 3/1971 Rutter ..... 405/3
4,832,210 A * 5/1989 Wood, II ..... 405/3
5,234,285 A * 8/1993 Cameron ..... 405/2
5,374,156 A * 12/1994 Simpson et al. ..... 405/3
5,449,247 A * 9/1995 Smith ..... 405/3
5,641,242 A * 6/1997 Riviere ..... 405/3

(Continued)

FOREIGN PATENT DOCUMENTS

DE 195 00 182 7/1996

(Continued)

OTHER PUBLICATIONS

International Search Report.

*Primary Examiner*—Frederick L Lagman
(74) *Attorney, Agent, or Firm*—Collard & Roe, P.C.

(57) ABSTRACT

The invention relates to a device for a watercraft for picking up and launching boats. The device comprises an extension arm that is coupled in such a manner that it can swing freely on the watercraft, that extends at an acute angle in relation to the surface of the water and floats in water by means of floats. The extension arm comprises guide tracks for a boat retrieving device that is maintained on the extension arm in a longitudinally displaceable manner. The boat retrieving device comprises a holding head that is articulated in a displaceable manner on a running part guided on the guide rails, about an axis that is horizontal and approximately transversal in relation to the extension arm. The running part is connected to the drive means for longitudinally displacing the boat retrieving device. The holding head comprises at least one adjusting means that acts upon its adjusting movement about the horizontal axis.

18 Claims, 4 Drawing Sheets

U.S. PATENT DOCUMENTS

Figure 1:
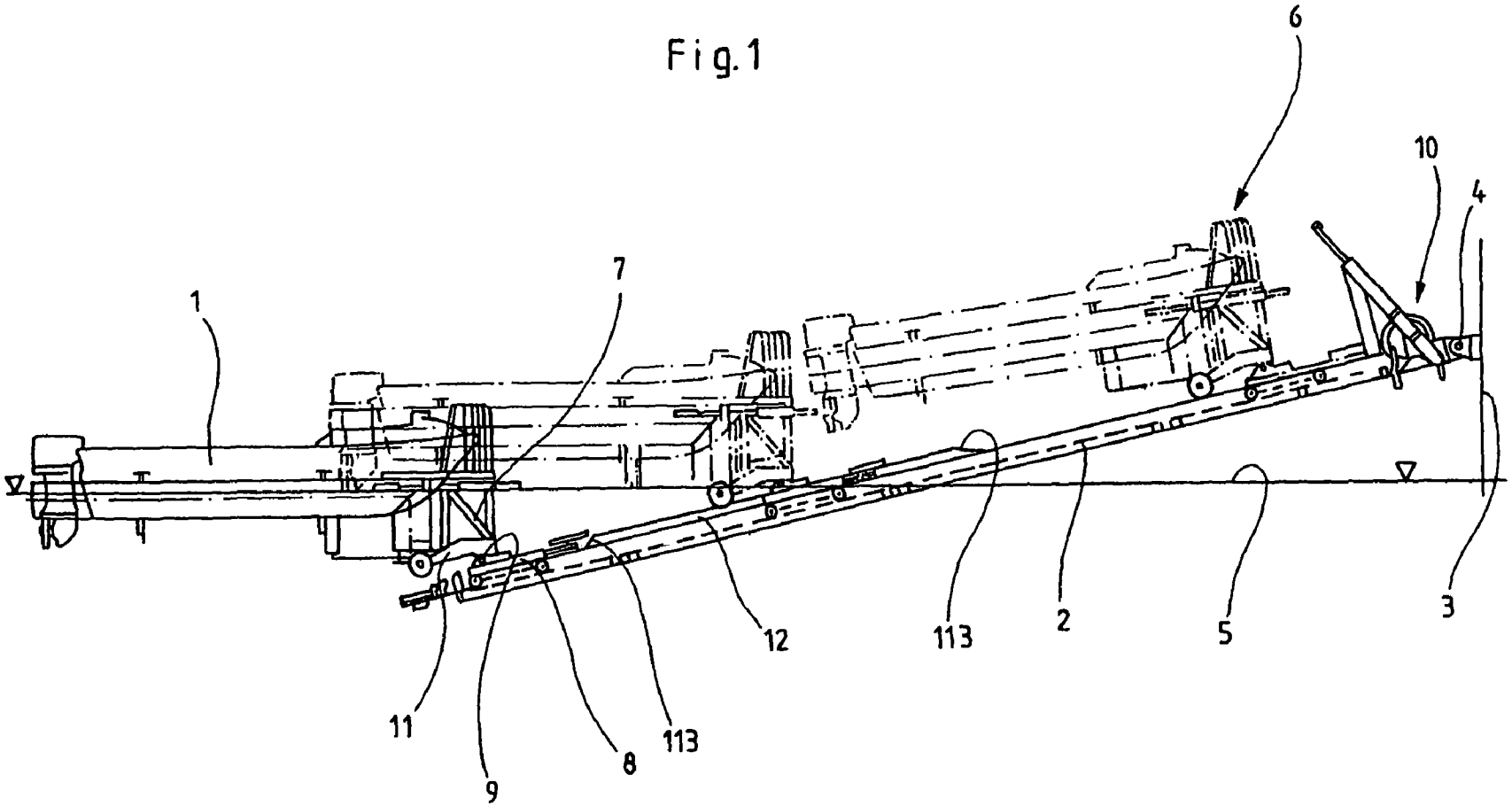

| | | | | |
|---|---|---|---|---|
| 6,182,597 | B1 * | 2/2001 | Maxwell et al. | 405/2 |
| 7,293,521 | B1 * | 11/2007 | Johns et al. | 405/3 |
| 2005/0150064 | A1 | 7/2005 | Hill | |
| 2006/0177271 | A1 * | 8/2006 | Maffett et al. | 405/3 |

FOREIGN PATENT DOCUMENTS

| | | |
|---|---|---|
| FR | 2 823 481 | 10/2002 |
| GB | 2 292 911 | 3/1996 |
| JP | 59-008587 | 1/1984 |

* cited by examiner

DEVICE FOR A WATERCRAFT FOR PICKING UP AND LAUNCHING BOATS

CROSS REFERENCE TO RELATED APPLICATIONS

This application is the National Stage of PCT/DE2007/001545 filed on Aug. 29, 2007, which claims priority under 35 U.S.C. §119 of German Application No. 10 2006 040 617.6 filed on Aug. 30, 2006. The international application under PCT article 21(2) was not published in English.

The invention relates to a device for a watercraft for picking up and launching boats, having a boom whose one end is articulated onto the watercraft, so as to pivot freely about an axis oriented horizontally, in such a manner that it extends at an acute angle relative to the water surface, whereby it floats in the water by means of flotation bodies disposed in the region of the free end, and having guide rails for a boat retrieval device held on the boom so as to move longitudinally, for the longitudinal movement of which drive means are provided, whereby the configuration of the boat retrieval device is similar to that of a slip carriage, whose side walls that pick up the boat between them are at least partially configured as gripper shanks that can pivot about a perpendicular axis, in each instance.

A device of the aforementioned type is known from the patent DE 195 00 182 C2.

In the known device, the free end of the boom lies beneath the water surface and is held in a predetermined floating position by means of flotation bodies. The boat retrieval device can move longitudinally on the boom, and is situated in the vicinity of the submerged, free end of the boom when the boat is picked up. In this connection, the retrieval device is at least partially submerged below the water surface. As soon as the boat has moved into the boat retrieval device between the gripper shanks, the gripper shanks can close. The retrieval device can then be moved upward along the boom, whereby the bow of the boat comes out of the water first during transport along the boom. The bow region that has emerged from the water is therefore no longer involved in flotation of the boat, so that its stern region, which is still floating, submerges deeper into the water. The boat gets into an undesirable slanted position, i.e. it is forced into a slanted position while it is still floating in the water, which position runs approximately parallel to the slanted plane of the boom.

The invention is based on the task of improving the known device with regard to the pick-up and launching process, respectively.

This task is accomplished by a device for a watercraft for picking up and launching boats in accordance with the invention. Further developments and advantageous embodiments are discussed below. To accomplish the task on which the invention is based, it is provided, according to the invention, that the boat retrieval device can move about an axis that is oriented horizontally and approximately crosswise to the boom. The running part is connected with drive means for the longitudinal movement of the boat retrieval device, and the holder head has at least one setting means that brings about its setting movement about the horizontal axis. The boat retrieval device is therefore articulated onto the running part that can move along the boom, by way of the holder head, specifically by means of a joint that allows movement of the retrieval device about an axis that runs horizontally and crosswise to the boom. Slanted positions, with the flotation problems that result from them, which have disadvantageous effects in the case of waves, in particular, are avoided in that the entire boat retrieval device can be brought into a predetermined angle relative to the slanted plane of the boom, for example in that a setting movement about the horizontal axis can take place using the setting means.

It is particularly advantageous if the holder head, having the bearing that forms the horizontal axis, is situated in the region of the front end of the boat retrieval device, whereby the front end of the boat retrieval device corresponds to the side that faces the attachment bearing of the boom on the ship. Of course, it is also possible to provide the holder head more or less behind the front end of the boat retrieval device. It is essential that the head is disposed in such a manner that the possibility of tilting the retrieval device about the horizontal axis is obtained, with the advantage that the boat to be picked up remains in the horizontal floating position, with optimal flotation, for as long as possible, until it has climbed far up enough along the boom, together with the boat retrieval device, that is has come more or less completely out of the water. As soon as this position has been reached, the setting means bring about a setting movement, i.e. the holder head and with it the boat retrieval device are pivoted about the horizontal axis until the boat has assumed an approximately parallel orientation relative to the boom. Once the boat has assumed this position, it can be moved completely along the boom, and, if necessary, brought into the interior of the watercraft through an opening in the side of the watercraft.

The gripper shanks, which practically form a pick-up vise, are articulated onto the holder head in such a manner that they can be opened and closed, preferably in the end position, in which the boat retrieval device is situated at the free end of the extended boom.

The setting means for implementing the setting movement of the holder head, i.e. of the boat retrieval device coupled with it, have at least one steering lever disposed on the holder head, as well as a steering track disposed on the boom, for deflection of the steering lever that can be moved along the steering track. With this, a simple mechanical design configuration of a setting means is achieved. In this connection, the configuration is arrived at in such a manner that every steering track has at least one track section that is configured as a run-up flank that projects into the movement path, along which the steering lever is guided along the boom during a movement of the boat retrieval device. In this way, the steering track fulfills the function similar to a cam control, and is configured in such a manner that it pivots the steering lever by means of deflection, when the steering lever moves down the steering track. This downward movement takes place during a longitudinal movement of the boat retrieval device along the boom.

Of course, it is also possible to provide corresponding mechanisms as setting means, for example work cylinders that engage on the steering lever. Stepper motors with corresponding gear mechanisms, which could act on the steering lever disposed on the holder head, in order to move the holder head and thus the boat retrieval device about the horizontal axis, are also certainly possible.

In the known devices, the boom is a lattice construction composed of profile rods. The profile rods are hollow profiles sealed at the ends, which are disposed to run parallel and in the longitudinal direction of the boom. At the same time, the hollow profiles form the guide rails for the boat retrieval device.

It is advantageous if the running part is configured as a rolling carriage that can be moved using the drive means, which carriage can move along the guide rails of the boom, carrying with it the holder head and the gripper shanks of the boat retrieval device that are articulated on the latter. Of course, it is also possible to configure the running part as a sled guided on the guide rails.

A steering track is disposed on at least one of the guide rails, which track is provided for deflecting the steering lever of the holder head that moves down the guide rail. The guide rail can also be configured as a steering track.

The boat retrieval device has pivot means for the gripper shanks, in order to be able to open and close the gripper shanks in vise-like manner. The pivot means can be work cylinders, for example. Each pivot means has a pivot lever situated in the region of its articulation onto the holder head, on the gripper shank, in each instance, and a pivot lever activation device that acts on the pivot lever. A work cylinder that engages on the pivot lever could form such a pivot lever activation device of a pivot means.

It is particularly advantageous if every pivot lever activation device is a tension means attached to the pivot lever, as well as a pressure means supported on the boom. The pressure means can be a pressure spring, for example, which is supported on the boom, in order to release a bias that is stored in the tension means when no tension is applied, by means of which the gripper shanks are pivoted into the spread position, in which the boat retrieval device is open. The tension means can be a cable, for example, which can be put under tensile stress by means of suitable mechanisms, for example also a work cylinder or electric winches, which stress can be transferred to the pivot levers, and thus to the gripper shanks. By means of the tensile force, the gripper shanks are brought into the closed position, in which they enclose the boat to be picked up between them. At the same time, the tensile force can be utilized for deflecting the pressure means.

According to a particularly advantageous embodiment, for which independent protection is also being claimed, the drive means for the longitudinal movement of the boat retrieval device along the boom have a cable drive with at least one winch, and with an endless cable that runs over multiple deflections. Using such an endless cable, it is also possible to connect the tension means of the pivot lever activation device, so that the drive means serve not only for the movement of the boat retrieval device along the boom, but also, at the same time, take care of pivoting the gripper shanks of the boat retrieval device, to pick up the boat that has moved in between the gripper shanks.

The device according to the invention is therefore relatively easy to operate. Only a single drive organ for the winch, which must be controlled and provided with drive power, is required. All of the movements that take place on the device for picking up or launching a boat are brought about and controlled by way of the winch and the endless cable.

The endless cable is attached to the retrieval device, preferably to the holder head of the retrieval device, by way of a suitable connection element. The endless cable runs by way of multiple deflections, one of which is configured as a cable tensioner that can be activated. The cable tensioner can have a work cylinder, for example, which engages on the bearing of the deflection roller and thus can move the entire deflection roller in such a way that the endless cable is tightened or relaxed.

The endless cable also runs over other deflections, one of which is situated at the free end of the boom, to an external winch. This winch is preferably installed in the interior of the watercraft, particularly in a region there into which a picked-up boat is pulled and in which the entire boom can also be accommodated, for example by retracting its bearing point.

The endless cable of the drive means can transfer tensile forces to the tension means of the pivot lever activation device for the gripper shanks, which are present as a cable. The tension means of the pivot lever activation device can be dragged along, for example, by means of operating the winch. This is achieved in that the tension means, present as a cable, runs over deflection rollers mounted on the boat retrieval device and over a loose roller. At least one part of the endless cable brought up by the winch of the drive means is connected with the mounting of the loose roller.

This configuration has the advantage that the drive means for the boat retrieval device, in connection with the configuration of one of the deflections of the endless cable, as a cable tensioner that can be activated, can be used to produce a movement of the loose roller. In this way, in the final analysis, the cable tensioner also acts as a pivoting means for the gripper shanks of the boat retrieval device. Activation of the cable tensioner, for example by means of a work cylinder, brings about the result that the tensed endless cable pulls on the loose roller, over which the tension means of the pivot lever activation means run. This tension movement of the loose roller produces a tensile force on the tension means that are present as a cable, which force leads to pivoting of the pivot lever, in each instance, that is assigned to one of the gripper shanks. As a result, the gripper shank is then also moved, specifically and advantageously in a closing movement. At the same time, the pressure means of the pivot lever activation device coupled with this gripper shank are biased by this closing movement. This is possible because the pressure means are a pressure spring, which stores the pressure force produced by the closing movement of the gripper shanks, and can release it again when the cable tensioner of the endless cable is activated in such a manner that the endless cable becomes loose. This is possible if the boat retrieval device has been brought into an end position with the drive means, i.e. with the winch and the endless cable, in which position the boat retrieval device is situated at the free end of the boom. In this position, the boat retrieval device is at least partially submerged below the water surface.

For the cable tensioner, i.e. for its work cylinder, and for the winch, controls are provided, and for the winch, controllable activation devices are provided, which are equipped with a coupling element that reciprocally influences their operation. In this way, the result is achieved that the winch cannot function as long as the cable tensioner is activated, and vice versa.

The activation device for the winch and the control of the cable tensioner are preferably coupled with one another by means of programmable control and regulation electronics, whereby it is particularly advantageous if the control and regulation electronics have a wireless remote control. In this way, it is possible to control both the operation of the winch and the operation of the cable tensioner, and thereby, in the final analysis, of the boat retrieval device, while adhering to the prescribed safety circuits, also from the boat that is being or has been picked up.

Figure 2:
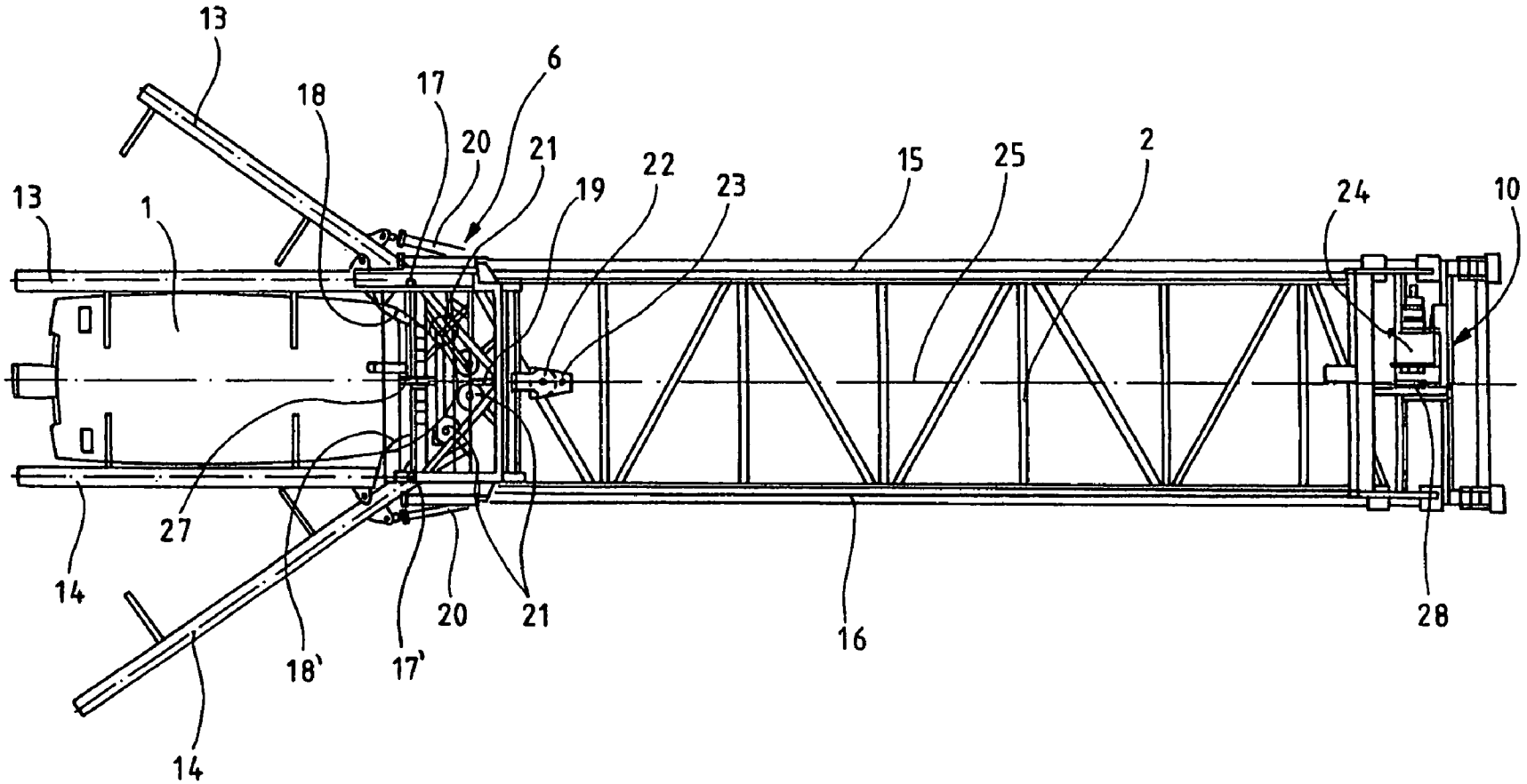
Figure 3:
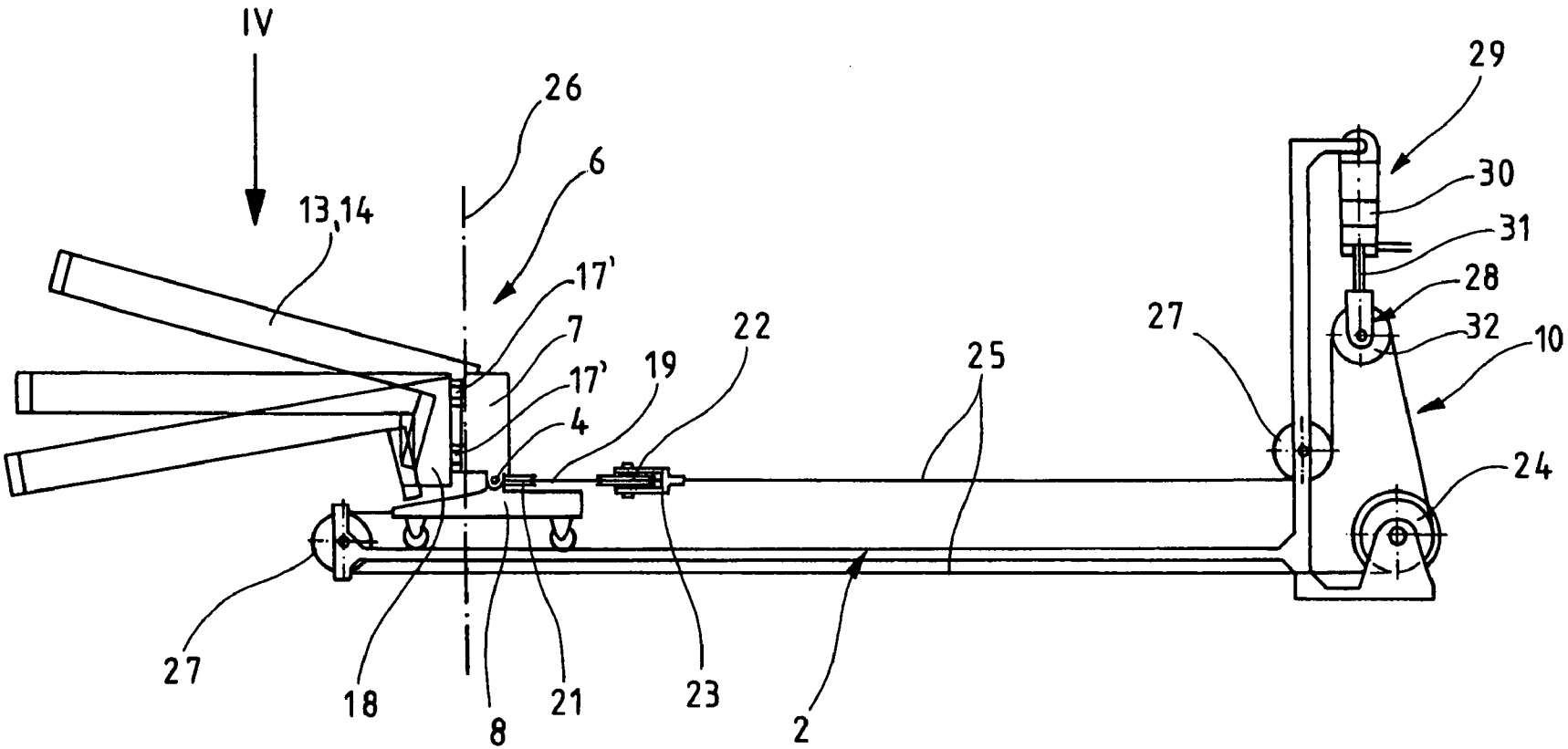
Figure 4:
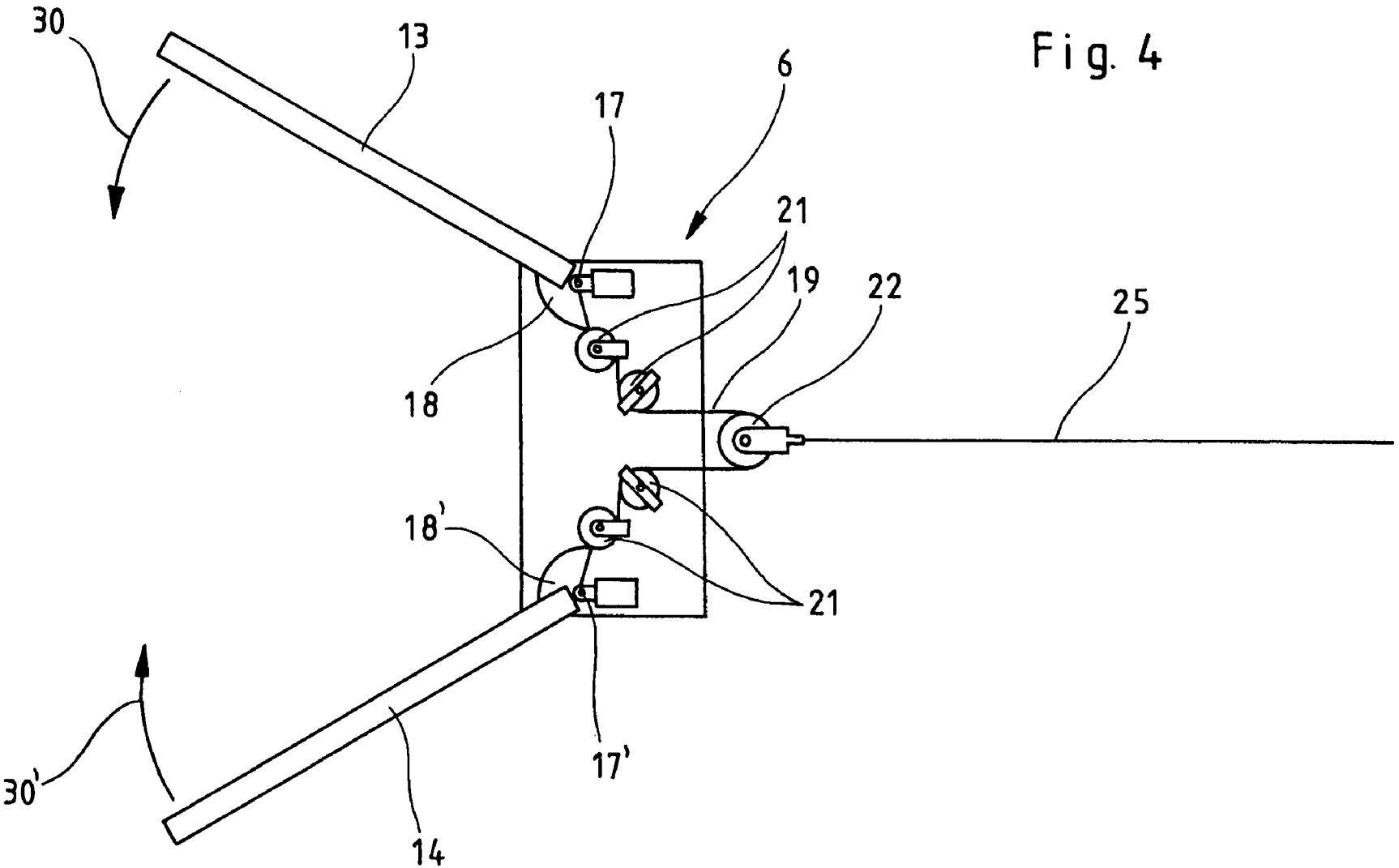

An exemplary embodiment of the invention, from which other inventive characteristics are evident, is shown in the drawing. This shows:

FIG. 1: a schematic side view of the device for picking up and launching boats, FIG. 2: a schematic top view of the device according to FIG. 1, FIG. 3: a fundamental diagram of the device in a side view, corresponding to FIG. 1, and FIG. 4: a view of a detail from the fundamental diagram, seen in the direction of the arrow IV in FIG. 3.

In the view of a device for picking up and launching boats 1 shown in FIG. 1, this device has a boom 2 that is articulated onto the watercraft, indicated by a vertical line 3 of its outline here, to pivot freely about a horizontal axis 4, with its free end. With the free end, the boom 2 is held at an acute angle relative to the water surface 5. The end of the boom 2 that is articulated on is situated above the water surface 5, so that the boom 2 runs like a slanted ramp between the water surface 5 and the axis 4. In the region of its free end, the boom 2 has a boat retrieval device 6 assigned to it, in which a boat 1 is accommodated. Different positions of the boat retrieval device 6 with the boat 1, with regard to the longitudinal expanse of the boom 2, are indicated with dot-dash lines.

The configuration of the boat retrieval device 6 is similar to that of a slip carriage. The boat retrieval device 6 has a holder head 7 that is articulated onto a running part 8, about an axis 9 that is oriented horizontally and approximately crosswise to the boom 2, and whose movements can be set.

The running part 8 is connected with drive means 10 for running part 8 and thus for the boat retrieval device 6 including boat 1 along the boom.

The holder head 7 has at least one setting means that brings about its setting movement about the horizontal axis 9. Here, the setting means is configured in such a manner that it has at least one steering lever 11 disposed on the holder head 7, as well as a steering track 12, disposed on the boom 2, for deflection of the steering lever 9 when the boat retrieval device, and thus its holder head, which has the steering lever, is moved along the boom with the drive element 10.

The boat retrieval device 6 is let down along the boom, up to its lower, free end, which is submerged into the water, using the drive means 10. In this position, the boat 1 can be moved into the boat retrieval device and fixed in place. Subsequently, the gripper shanks of the boat retrieval device close; these are also articulated onto the holder head 7. As soon as the gripper shanks 7 are closed, the drive means can start to pull the running part 8, on which the holder head 7 is articulated, along the boom 2, upward, out of the water. In this connection, the boat 1 at first maintains its horizontal floating position, because the steering lever 11 is deflected at a slant upward by the steering track 12 during the longitudinal movement along the boom 2. The steering lever 11 runs up onto a track section of the steering track 12, which is configured as a run-up flank 113, and, because this projects into the movement path along which the steering lever 11 can be moved during a movement of the boat retrieval device along the boom 2, the steering lever 11 holds the boat picked up in the boat retrieval device in a predetermined angle relative to the boom during the further upward movement of the boat retrieval device.

Only once the boat retrieval device has been pulled up so far that it has approached the upper end of the boom, articulated on by way of the axis 4, does the run-up flank 113, by means of the steering lever 11, return the holder head 7 back into a position in which the boat retrieval device 6, and particularly the boat accommodated in it, is situated approximately parallel to the boom again.

FIG. 2 shows a front view of the device according to FIG. 1, seen from above. The same components are indicated with the same reference numbers.

FIG. 2 particularly clarifies the configuration of the boat retrieval device with its two gripper shanks 13 and 14 that can be tilted about approximately vertical axes, and can be tilted together into a position in which the gripper shanks 13', 14' hold the boat 1 that is accommodated between them.

FIG. 2 shows that the boom 2 is configured as a frame construction having two essentially parallel longitudinal crossbeams, which serve as guide rails 15 and 16 for the running part 8 that is present as a rolling carriage. The guide rails are indicated as 15 and 16. The boat retrieval device 6 has pivot means for the gripper shanks 13 and 14. Each pivot means comprises a pivot lever 18, 18' that is situated in the region of its articulation 17, 17' on the holder head 7, at the gripper shank 13 and 14, respectively, in each instance, and a pivot lever activation device that acts on the pivot lever. Each pivot lever activation device has a tension means 19 (dot-dash line) attached to the pivot lever 18, 18', as well as a pressure means 20 and 20', respectively, supported on the boom 2, which can be biased by the tension of the tension means 19. Each tension means 19 is a cable that runs by way of deflection rollers 21 mounted on the boat retrieval device 6 and a loose roller 22; the endless cable 25 brought in from the winch 24 of the drive means is connected with the mounting 23 of the loose roller.

The drive means 10 therefore has a cable drive having at least one winch 24 and one endless cable 25 that runs by way of multiple deflections 27 and 28.

FIG. 3 is a schematic fundamental diagram of the device corresponding to FIG. 1. The same components are identified with the same reference numbers.

FIG. 3 makes it clear that the boat retrieval device 6, with its gripper shanks 13 (and 13', 14, and 14', respectively) is articulated onto the holder head 7 about a vertical axis 26, so as to pivot. The holder head 7, in turn, is articulated onto the running part 8, about an axis 4 that is horizontal and oriented approximately crosswise to the boom 2, to allow setting movements, as was described in connection with FIG. 1.

The endless cable 25 runs over several deflections 27, of which one is situated at the free end of the boom 2. The endless cable runs from there back to the winch 24, whereby it can drag the rolling carriage 8 along. In the case of this embodiment, however, it is provided that the endless cable is attached to the rolling carriage at one point, and also to the loose roller 22, i.e. its mounting 23.

The tension means 19 run by way of the loose roller 22, specifically by way of multiple deflection rollers 21, in order to engage the pivot means 18, which are used to pivot the gripper lever 13 about the vertical axis 17'.

The running carriage 8 with the gripper shanks 13 is pulled with the drive means 10, i.e. with the cable winch 24 of the drive means, by means of the endless cable 25, over the deflection 27 at the front end of the boom, until the running carriage has been submerged below the water surface in the region of the free end of the boom 2. In this connection, a boat 1 accommodated between the gripper shanks 13 can float (FIG. 1).

When the running carriage 8 has reached this end position in the region of the free end of the boom 2, the winch 24 of the drive means 10 stops.

One of the deflections 27 for the endless cable 25 is configured as a cable tensioner, as indicated here in FIG. 3. The cable tensioner has a work cylinder 30 having a piston rod 31, the free end of which is connected with the mounting of the deflecting tensioning roller 32 of the cable tensioner 29.

In FIG. 3, the tensioning roller 32 has been moved, by means of the piston rod 31, to such an extent that the tension means 19 are relatively free of tension. The pressure means shown in FIG. 1, which are biased, can therefore pivot the gripper shanks 13, 14 about the vertical axes 17, 17', outward, into an open position. As soon as the boat has moved in between the gripper shanks 13, 14, pressure medium is pumped into the work cylinder 30, thereby causing the piston rod 31 to move in and, when this happens, the tensioning roller 32 tightens the endless cable 25. This brings about the result that the loose roller 22 is pulled, so that the tension means 19 are put under tensile force. This tensile force brings about the result that the gripper shanks 13 and 14 pivot into the position shown in FIG. 2, in which they hold the boat 1 that is accommodated between them. If the tensioning roller 32 is fixed in place in this position, the boat retrieval device 6, with the boat 1 accommodated in it, can subsequently be pulled out of the water, by means of the endless cable 25, along the boom, by operating the winch 24.

FIG. 4 is a schematic top view of the device, seen in the direction of the arrow IV in FIG. 3. The same components are indicated with the same reference numbers.

FIG. 4 particularly clarifies the progression of the tension means 19 over the loose roller 22, which can be moved by means of the cable tensioner 29, which is not further visible here, by means of tensioning the endless cable 25. By means of this movement, which takes place relative to the boat retrieval device 6 that is held in place on the boom by means of the endless cable, tension is exerted on the tension means 19, which has an effect on the pivot levers 18, 18' at the ends of the gripper shanks 13, 14, in such a manner that the gripper shanks pivot inward in the direction of the arrows 30 and 30', about the vertical axes 26. As shown here, the tension means 19 runs over multiple deflection rollers 21 mounted on the boat retrieval device 6.

In this exemplary embodiment, the drive means are disposed on the boom 2, with the winch and the cable tensioner. Preferably, however, the drive means are accommodated within the ship, in other words external to the boom, and therefore protected.

It is certainly possible to also equip previously determined deflection rollers with work cylinders, which allow movement of the mounting of the deflection roller, in each instance, similar to cable tensioners, and thereby the movements of the mountings that take place during activation of the winch can be supported or balanced out. Of course, it is also possible to carry out a corresponding movement of elements of the retrieval device with the work cylinders alone, if the winch is put out of operation.

Safety technology circuits are usual, of course, and remote control can also be used to particular advantage, for example radio remote control, in order to be able to activate and control both the drive means and the boat retrieval device from the boat.

The invention claimed is:

1. A device for a watercraft for picking up and launching boats, the device comprising a boom having a first end articulated onto the watercraft, so as to pivot freely about a first axis oriented horizontally, in such a manner that the boom extends at an acute angle relative to the water surface, whereby the boom floats in the water by means of flotation bodies disposed in a region of a free end of the boom, and having guide rails for a boat retrieval device held on the boom so as to move longitudinally, whereby drive means for the longitudinal movement of the boat retrieval device are provided, whereby the boat retrieval device has side walls for picking up a boat between the side walls, whereby the side walls are at least partially configured as gripper shanks, whereby the gripper shanks can pivot about a perpendicular axis, in each instance, wherein the boat retrieval device has a holder head articulated onto a running part about a second axis oriented horizontally and approximately crosswise to the boom, so as to allow setting movements, whereby the running part is connected with the drive means for the longitudinal movement of the boat retrieval device, and the holder head has at least one setting means for bringing about a setting movement of the holder head about the second axis, wherein the at least one setting means has at least one steering lever disposed on the holder head, as well as a steering track disposed on the boom, for deflection of the steering lever, wherein the steering lever can be moved along the steering track, and wherein each steering track has at least one track section configured as a run-up flank, the at least one track section projecting into a movement path, whereby the steering lever can be moved along the movement path during a movement of the boat retrieval device along the boom.

2. The device according to claim 1, wherein the gripper shanks are articulated onto the holder head.

3. The device according to claim 1, wherein the running part is configured as a rolling carriage moveable along the guide rails of the boom, using the drive means.

4. The device according to claim 1, wherein the boat retrieval device has pivot means for the gripper shanks.

5. The device according to claim 4, wherein each pivot means has a pivot lever situated on the gripper shank, in each instance, in a region of articulation of the gripper shanks onto the holder head, and a pivot lever activation device that acts on the pivot lever.

6. The device according to claim 1, wherein the drive means has a cable drive having at least one winch and having one endless cable running over multiple deflections.

7. The device according to claim 1, wherein at least one deflection of the drive means is configured as a cable tensioner, wherein the at least one deflection configured as a cable tensioner can be activated.

8. The device according to claim 7, wherein the cable tensioner has a work cylinder.

9. The device according to claim 8, wherein a control for the work cylinder is provided.

10. The device according to claim 1, wherein a winch of the drive means has a controllable activation device.

11. A device for a watercraft for picking up and launching boats, the device comprising a boom having a first end articulated onto the watercraft, so as to pivot freely about a first axis oriented horizontally, in such a manner that the boom extends at an acute angle relative to the water surface, whereby the boom floats in the water via flotation bodies disposed in a region of a free end of the boom, and having guide rails for a boat retrieval device held on the boom so as to move longitudinally, whereby drive means for the longitudinal movement of the boat retrieval device drive are provided, whereby the boat retrieval device has side walls for picking up a boat between the side walls, whereby the side walls are at least partially configured as gripper shanks, whereby the gripper shanks can pivot about a perpendicular axis, in each instance, wherein the boat retrieval device has a holder head articulated onto a running part about a second axis oriented horizontally and approximately crosswise to the boom, so as to allow setting movements, whereby the running part is connected with the drive means for the longitudinal movement of the boat retrieval device, and the holder head has at least one setting means for bringing about a setting movement, wherein the boat retrieval device has pivot means for the gripper shanks, wherein each pivot means has a pivot lever situated on the gripper shank, in each instance, in a region of articulation of the gripper shanks onto the holder head, and a pivot lever activation device, wherein the pivot lever activation device acts on the pivot lever, and wherein each pivot lever activation device has a tension means attached to the pivot lever as well as a pressure means supported on the boom, wherein the pressure means can be biased by tension of the tension means.

12. The device according to claim 11, wherein each pressure means is a pressure spring.

13. The device according to claim 11, wherein each tension means is a cable.

14. The device according to claim 13, wherein the tension means are present as a cable run by way of deflection rollers mounted on the boat retrieval device and a loose roller, whereby the endless cable brought in from the winch of the drive means is connected to the loose roller via a mounting of the loose roller.

15. A device for a watercraft for picking up and launching boats, the device comprising a boom having a first end articulated onto the watercraft, so as to pivot freely about a first axis oriented horizontally, in such a manner that the boom extends at an acute angle relative to the water surface, whereby the boom floats in the water via flotation bodies disposed in a region of a free end of the boom, and having guide rails for a boat retrieval device held on the boom so as to move longitudinally, whereby drive means for the longitudinal movement of the boat retrieval device drive are provided, whereby the boat retrieval device has side walls for picking up a boat between the side walls, whereby the side walls are at least partially configured as gripper shanks, whereby the gripper shanks can pivot about a perpendicular axis, in each instance, wherein the boat retrieval device has a holder head articulated onto a running part about a second axis oriented horizontally and approximately crosswise to the boom, so as to allow setting movements, whereby the running part is connected with the drive means for the longitudinal movement of the boat retrieval device, and the holder head has at least one setting means for bringing about a setting movement, wherein at least one deflection of the drive means is configured as a cable tensioner, wherein the at least one deflection configured as a cable tensioner can be activated, wherein the cable tensioner has a work cylinder, wherein a control for the work cylinder is provided, and wherein a coupling element is disposed between the control of the work cylinder and an activation device of a winch of a cable drive of the drive means, wherein the coupling element reciprocally influences operation of the work cylinder and the activation device.

16. The device according to claim 15, wherein the work cylinder has a piston rod having a free end connected with a mounting of a deflecting tensioning roller of the cable tensioner.

17. The device according to claim 15, wherein the coupling element is configured as programmable control and regulation electronics.

18. The device according to claim 17, wherein the control and regulation electronics have a wireless remote control.

* * * * *